US006292338B1

(12) United States Patent
Bernhoff et al.

(10) Patent No.: US 6,292,338 B1
(45) Date of Patent: Sep. 18, 2001

(54) ELECTRIC COUPLING DEVICE, ELECTRIC CIRCUIT AND METHOD IN CONNECTION THEREWITH

(75) Inventors: Hans Bernhoff; Henrik Breder; Jan Isberg; Lars Jonsson; Lars Liljestrand; Stefan Valdemarsson, all of Västerås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/402,485

(22) PCT Filed: Apr. 14, 1998

(86) PCT No.: PCT/SE98/00680

§ 371 Date: Dec. 8, 1999

§ 102(e) Date: Dec. 8, 1999

(87) PCT Pub. No.: WO98/49695

PCT Pub. Date: Nov. 5, 1998

(30) Foreign Application Priority Data

Apr. 14, 1997 (SE) ..... 9701372

(51) Int. Cl.[7] ..... H01C 7/00

(52) U.S. Cl. ..... 361/58; 338/13; 338/100

(58) Field of Search ..... 338/20, 22 R, 338/47, 13, 36, 99, 100, 110; 361/58, 106, 93.1

(56) References Cited

U.S. PATENT DOCUMENTS

| | | | | |
|---|---|---|---|---|
| 3,648,119 | * | 3/1972 | Van Eeck | 361/435 |
| 3,790,870 | * | 2/1974 | Mitchell | 338/22 R |
| 4,163,204 | * | 7/1979 | Sado et al. | 338/100 |
| 4,475,138 | * | 10/1984 | Middleman et al. | 361/58 |
| 4,691,187 | * | 9/1987 | Mon | 338/114 |
| 4,811,478 | * | 3/1989 | Maier et al. | 338/22 R |
| 4,890,186 | * | 12/1989 | Matsubara et al. | 361/58 |
| 4,937,696 | * | 6/1990 | Yoshino et al. | 361/58 |
| 4,977,357 | * | 12/1990 | Shrier | 338/20 |
| 4,977,386 | * | 12/1990 | Lodini | 334/114 |
| 5,036,306 | * | 7/1991 | Bergkvist | 338/47 |
| 5,247,276 | * | 9/1993 | Yamazaki | 338/22 R |
| 5,296,996 | * | 3/1994 | Hansson et al. | 361/106 |
| 5,565,826 | * | 10/1996 | Karlstrom | 361/58 |
| 5,581,192 | * | 12/1996 | Shea et al. | 361/58 |
| 5,644,283 | * | 7/1997 | Grosse-Wilde et al. | 338/47 |
| 5,969,928 | * | 10/1999 | Hashimoto et al. | 361/58 |
| 6,124,780 | * | 9/2000 | Duggal et al. | 338/20 |
| 6,128,168 | * | 10/2000 | Arnold et al. | 361/58 |
| 6,133,820 | * | 10/2000 | Duggal et al. | 338/99 |

FOREIGN PATENT DOCUMENTS

| | | | |
|---|---|---|---|
| 0 657 062 | | 6/1995 | (EP) . |
| 55-5531 | * | 1/1980 | (JP) . |
| 59-11343 | * | 1/1984 | (JP) . |
| 6-77542 | * | 3/1994 | (JP) . |
| WO 93/21677 | | 10/1993 | (WO) . |

* cited by examiner

*Primary Examiner*—Fritz Fleming
*Assistant Examiner*—Rios Roberto
(74) *Attorney, Agent, or Firm*—Oblon, Spivak, McClelland, Maier & Neustadt, P.C.

(57) ABSTRACT

An electric coupling device for connecting, disconnecting or limiting the current in an electric circuit. The electric coupling device includes a variable resistor. This resistance is variable between a very low value corresponding to a conducting state and a very high value corresponding to a substantially insulating state. Switching between the states takes place continually and in a very short time. The invention relates to an electric circuit provided with such an electric coupling device and a method performed in accordance with the function of the electric coupling device.

17 Claims, 6 Drawing Sheets

ELECTRIC COUPLING DEVICE, ELECTRIC CIRCUIT AND METHOD IN CONNECTION THEREWITH

BACKGROUND OF THE INVENTION

1. Field of the Invention

The present invention relates to an electric coupling device, to an electric circuit provided with such an electric coupling device and to methods for connecting, disconnecting and/or limiting the current in an electric circuit.

2. Discussion of the Background

Considerable advantages could be gained if the short-circuiting current in an electric power system could be limited. No expedient current limiter exists today apart from fuses. Increased demands on the quality of electric power accentuates the need for current limiters. Current limiters based on electric arcs, resonance circuits or semiconductors are usually so bulky and expensive that they cannot be considered for other than extremely specialised purposes.

Various types of surge arresters have long been used to limit the voltage in electrical systems and providing a current limiter which, similar, is inexpensive, small and simple would satisfy an urgent need. It is desirable for the voltage over the current limiter to be dependent only on the current strength.

An equivalent need also exists in connection with connecting and disconnecting the load current in an electric circuit and it would be desirable to achieve this without electric arcs and with more efficient attenuation of oscillations in the system.

SUMMARY OF THE INVENTION

Against this background the object of the present invention is to provide an electric coupling device for limiting, connecting or disconnecting the current in an electric circuit, which can also be used for high currents, which is simple, small and inexpensive, and which is free from electric arcs and also enables rapid attenuation. The object is also to provide a method whereby these objects are achieved.

From a first aspect the object of the invention has been achieved by means of an electric coupling device having the features defined in the characterizing part of claim 1. The invention relates to both direct current and alternating current.

Thanks to a resistor with the specified properties being included as an essential component in the electric coupling device, the current can be greatly limited when the resistor is controlled to its state with very high resistance. Since this occurs very rapidly the current can be limited before it causes damage to the electrical equipment connected. The continual alteration in the resistance also enables oscillations in the circuit to be quickly dampened. An electric coupling device of this type can also be made extremely small, simple and inexpensive, and without electric arcs.

Similar advantages are achieved when using the device as breaker or connector.

In a preferred embodiment the electric coupling device comprises an isolating switch arranged in series with the variable resistor, which facilitates the connection, disconnection and limiting functions of the electric coupling device.

Most suitably the resistor is of a type having pressure-dependent resistance so that the resistance decreases with increasing pressure, and vice versa. With a resistor of this type it is easy to rapidly alternate from the extreme states of the resistor. This therefore constitutes a preferred embodiment of the invention.

In a particularly preferred embodiment the pressure-dependent resistor is of a type comprising a powder where, in compressed state, the powder behaves as a homogenous conductor and in decompressed state has a large number of contact points and consequently high total resistance. A powder-based variable resistor is described in SE 971372-6, from which priority has been claimed for the present patent application. The resistor used in the present application is suitably of the type described in said Swedish patent application.

The resistor should be so constructed that the relation between the resistance in its substantially insulating state and in its conducting state is greater than $10^6$, preferably greater than $10^9$. The resistor should also be arranged for action times of less than 3 ms, preferably less than 200 $\mu$s. The short operating time ensures that no damaging current strength levels are reached during disconnection and current limiting. Furthermore, in the case of a powder-based resistor, a dynamic force is generated in the disintegration of the powder that facilitates a considerable change in resistance.

In another preferred embodiment the electric coupling device is provided with a resistor connected in parallel with the variable resistor. This second resistor may be linear or non-linear.

In yet another preferred embodiment a second contact is arranged in parallel with the variable resistor. The variable resistor can then be made more simple since a slightly larger resistance can be accepted in its low resistance state.

Alternatively a second contact may be arranged in series with the variable resistor and the first isolator.

An important application for the electric coupling device is as current limiter. The alteration in state of the variable resistor can then be arranged to occur depending on sensing of the current in the circuit. This constitutes another preferred embodiment of the invention.

The invention also relates to an electric circuit comprising the electric coupling device according to the invention when used for connecting and disconnecting an electric circuit and for limiting the current. Such an electric circuit exploits the advantages of the electric coupling device according to the invention as described above.

In such an electric circuit it is advantageous to arrange the electric coupling device close to the power consumption points in each branch of the electric circuit.

The invention also relates to the method of connecting, disconnecting and limiting the current in an electric circuit, the method being performed in a manner corresponding to the function of the electric coupling device according to the invention and offering equivalent advantages.

The invention offers advantages from many aspects. Protracted disturbances in the faulty branch downstream of the electric circuit device are reduced in the event of short-circuiting and there is a chance of immediate reparation. Brief disturbances in operation upstream of the electric coupling device are reduced and cause shorter or negligible voltage drop. The same applies to brief operational disturbances in parallel branches.

As regards the loads, higher available short-circuiting effect is possible for heavy starts, for instance, and the transformers can therefore be specified with lower short-circuiting reactance. Conditional connection of local generation is also possible so that extra transformers or other power detours are eliminated. Faster and more efficient protection of generators and machines is achieved and a greater freedom of choice in zero-point earthing for the machines is available. The connecting reactor or resistor is eliminated in capacitor banks and sensitive loads.

Lower requirements can be set for the mechanical dimensioning and strength of the equipment, thus enabling freer constructions and an opportunity of selecting compact and optimal geometries.

DESCRIPTION OF PREFERRED EMBODIMENTS OF THE INVENTION

Figure 1:
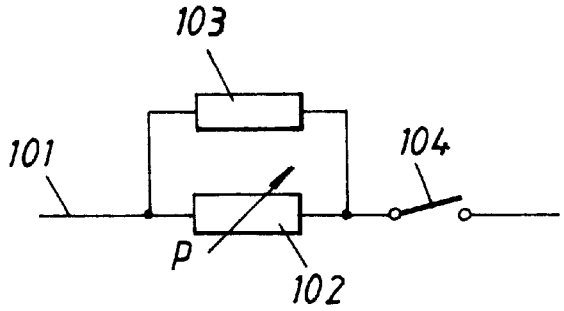
FIG. 1 illustrates schematically a first embodiment of the electric coupling device according to the invention.
Figure 2:
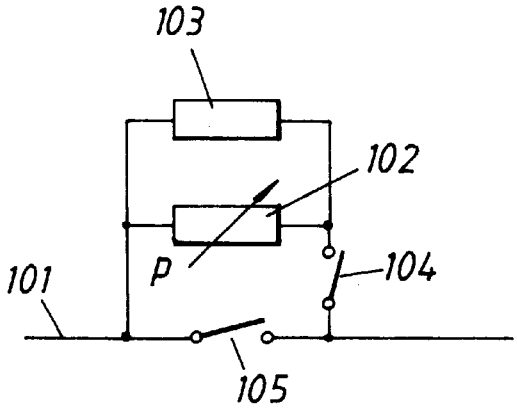
FIG. 2 shows schematically a second embodiment of the electric coupling device according to the invention.
Figure 3:
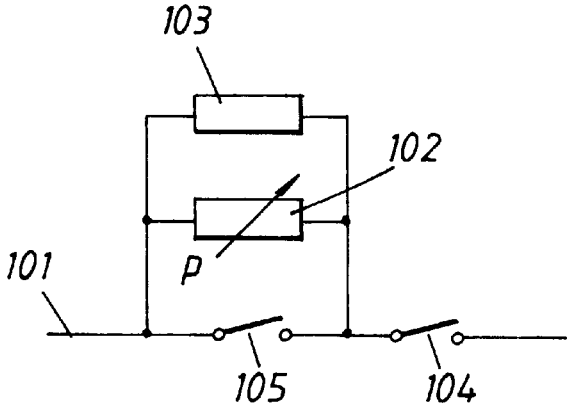
FIG. 3 shows schematically a third embodiment of the electric coupling device according to the invention.

FIGS. 1–3 show some examples of embodiments of the electric coupling device according to the invention. Although in its simplest form it may consist of only the variable resistor it is advantageous, as described in the introduction, for the electric coupling device also to include other types of components connected together in various constellations.

FIG. 1 shows an electric circuit with an electric coupling device in which a second resistor 103 is connected in parallel with the variable resistor 102 and an isolating switch 104 is connected in series with the variable resistor. The parallel-connected resistor may be linear or non-linear and in the latter case may consist of metal oxide, preferably ZnO. The variable resistor has a maximum resistance which is approximately $10^6$–$10^9$ times it's minimum resistance, and an action time of some ms for switching between conducting and substantially insulating states. The second resistor 103 has a resistance which is more than ten times the minimum resistance of the variable resistor 102 and less than ten times the maximum resistance of the variable resistor 102. The variable resistor may be a powder resistor of the type described in more detail with reference to FIGS. 9–17 and will in the following be termed a powder resistor.

The powder resistor is designed in the first place to assume one of the two states and no control of the resistance is therefore normally performed. The primary function of the powder resistor can thus be described as an on/off function. The rapid action time for changing state applies particularly to switching off, i.e. disconnecting or limiting the current whereas the action time is longer at switching on, i.e. connecting the current.

When being used as current limiter the isolating switch 104 in FIG. 1 may be eliminated.

FIG. 2 illustrates an alternative in which a second contact 105 is connected in parallel with the powder resistor 102 and isolating switch 104. In this embodiment the resistance of the powder resistor in conducting state may be permitted to be considerably higher than in the embodiment according to FIG. 1.

A modification of the embodiment according to FIG. 2 is shown in FIG. 3 where the second contact is connected in parallel with the powder resistor 102 but not the isolating switch 104.

The embodiment according to all the alternatives shown in FIGS. 1–3 can be used when disconnecting short-circuiting current and operating current with limitation.

Figure 3A:
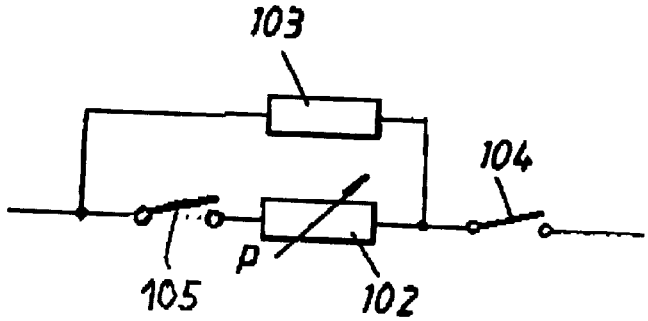
FIG. 3*a* shows schematically a fourth embodiment of the electric coupling device according to the invention.

FIG. 3*a* illustrates a further modification of FIG. 2 where the second contact 105 is connected in series with the powder resistor 102.

Figure 3B:
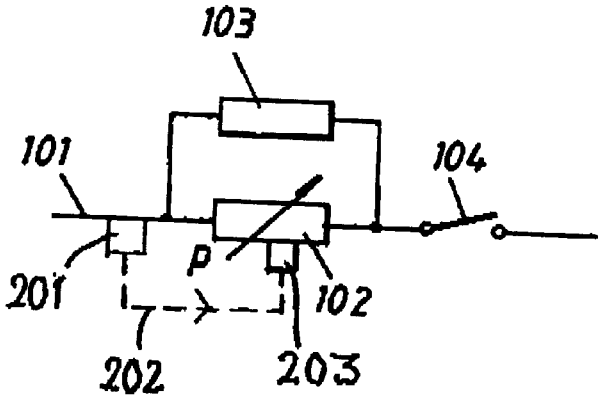
FIG. 3*b* shows schematically a fifth embodiment of the electric coupling device according to the invention.

FIG. 3*b* illustrates how the operation of an electric coupling according to the invention can be controlled. A sensor 201 is provided for sensing one or more parameters of the electric circuit. The sensor 201 can, e.g. be arranged to sense the current strength in the line 101 or it's time derivative. Signals from the sensor 201 are transmitted by signal means 202 to a control means 203 arranged to initiate switching of the state of the variable resistor 103 depending on the signals from the sensor 201.

Figure 4:
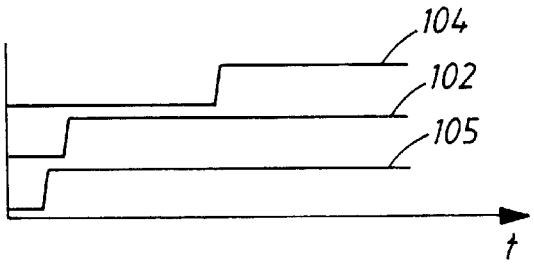
FIG. 4 is a time diagram illustrating disconnection of the electric coupling device according to the second and third embodiments.

FIG. 4 illustrates the disconnecting process in She embodiment according to FIGS. 2 and 3 along a time axis. The parallel-connected contact 105 is opened and shortly after the powder in the powder resistor 102 expands for disconnection, followed by opening of the series-connected isolating switch 104.

Figure 5:
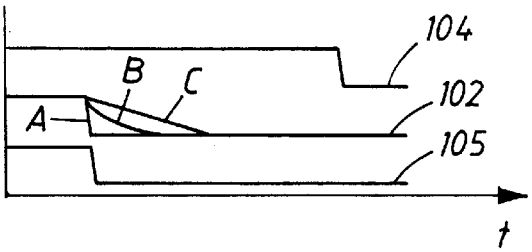
FIG. 5 is a time diagram illustrating connection of the electric coupling device according to the second and third embodiments, in a first alternative.

After disconnection the powder resistor can be connected, i.e. return to its low-resistive state, either with or without voltage. The latter is simplest since there is no need for speed in placing the powder in the resistor under pressure. The process is illustrated in FIG. 5. The parallel-connected isolating switch 105 is connected at the same time as switching on of the powder resistor 102 is initiated. As can be seen, the latter may take place quickly according to process A, but may just as well follow a slow process such as B or C and it is this which is used in practice. From the point of view of the power system, the connection process is identical to that of a conventional breaker.

Figure 6:
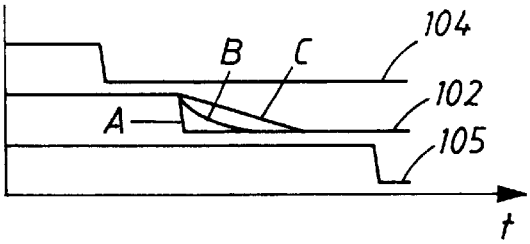
FIG. 6 is a time diagram illustrating connection of the electric coupling device according to the second and third embodiments, in a second alternative.

When the powder resistor is connected to voltage this can be achieved by first closing the series-connected isolating switch 104 and thereafter switching the powder resistor 102 to the low-resistive state, as illustrated in FIG. 6. Connection of the powder resistor takes somewhat longer in this case also, as shown at B and C. Connection is attenuated.

Figure 7:
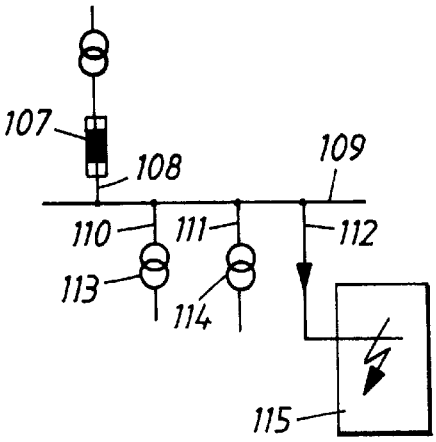
FIG. 7 illustrates schematically an electric circuit according to a first embodiment.

An electric coupling device of the type according to the invention can be inserted in the supply line in a network, as shown in FIG. 7. Here the electric coupling device 107 is arranged in a supply line 108 connected to a main line 9 from which branch conductors 110, 111, 112 lead to the load 113, 114, 115.

Figure 8:
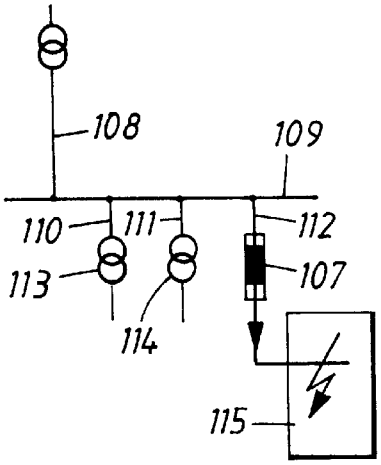
FIG. 8 illustrates schematically an electric circuit according to a second embodiment.

However, it is more advantageous to place an electric coupling device in each branch conductor, as shown in FIG. 8, only the electric coupling device 107 in the branch conductor 12 to the load 115 being drawn in. In the event of faults downstream of the electric coupling device 107 the damage is limited to only the branch conductor.

Figure 9:
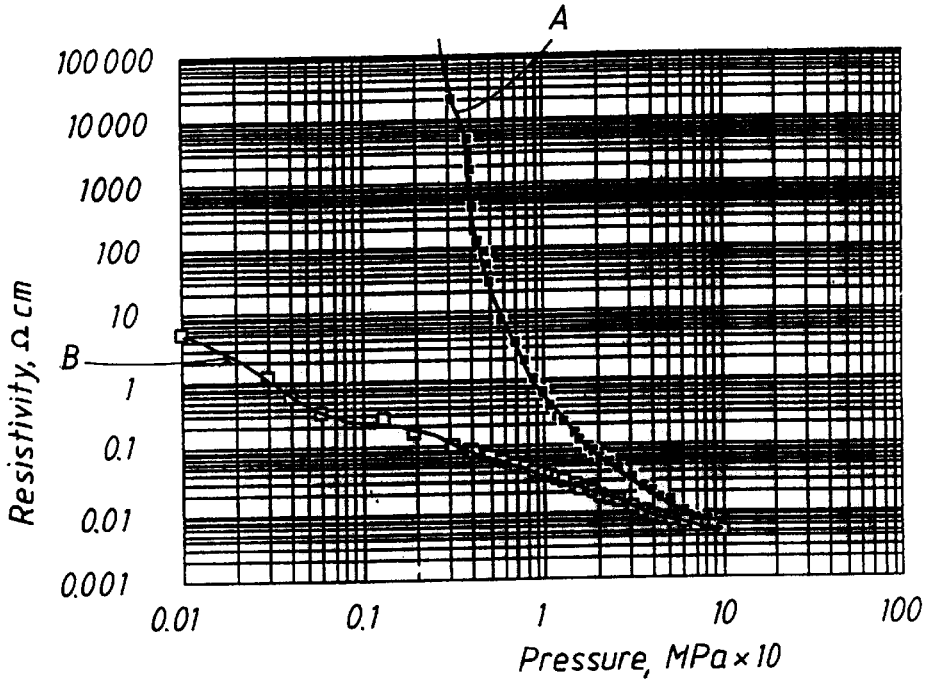
FIG. 9 is a diagram illustrating the principle of a resistor according to one embodiment of the invention.

The diagram in FIG. 9 illustrates the principle of a resistor suitable for use in the present invention. The diagram shows the resistivity of a powder consisting of 80% $TiB_2$ and 80% glass (weight by percentage) as a function of the pressure applied on the powder. The diagram is the result of an experiment in which the powder was originally in loose state and subsequently subjected to gradually increasing pressure. The pressure was then released slowly and gradually. Upon compression the loose powder was compressed and reduced in volume to a compact state and at the gradual pressure release the powder retained its compact state.

The solid points (curve A) indicate how the resistivity changed during the first part of the experiment, i.e. upon compression, and the unfilled points (curve B) indicate corresponding changes during the second part of the experiment, i.e. upon decompression of the powder without increased volume.

In both cases the resistivity decreased with increased pressure. The difference between the inclination of the curves is striking, however, showing that the pressure increase upon compression produces a dramatic decrease in resistivity whereas upon the following decompression without change in volume the resistivity increases considerably more slowly. Curve B thus illustrates the dependence on resistivity that is achieved only as a result of the difference in pressure. The ratio between highest and lowest resistivity is thus ten raised to a power many times lower than is required for applications of the type discussed in the introduction.

Curve A illustrates the dependence on resistivity achieved when not only the pressure, but also the volume is varied in parallel with the pressure. The resistivity is very high in the completely loosened state since the powder particles will only lightly touch each other when the powder is loose and has a larger volume.

The aim with the resistor according to the invention is, even during the decompression, to follow curve A, i.e. The compression curve. This can be achieved if the volume increases very rapidly in order to loosen the powder with a dynamic effect. Since the powder thus changes substantially instantaneously from compact, compressed state to expanded, decompressed state, the resistivity is increased some $10^7$–$10^9$ times or more, i.e. switches from being conducting to being insulating. An equivalent increase in resistivity if decompression takes place without an increase in volume is at most $10^2$–$10^3$.

Figure 10:
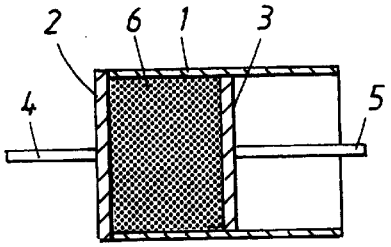
FIG. 10 shows schematically a resistor according to one embodiment of the invention in compressed state.
Figure 11:
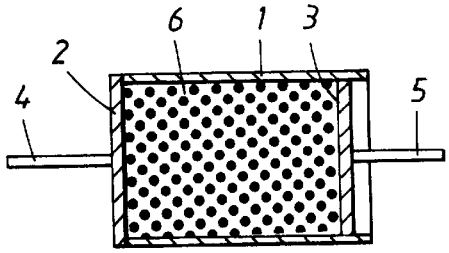
FIG. 11 shows schematically the resistor in FIG. 10 in expanded state.

FIGS. 10 and 11 illustrate the principle of a variable resistor according to the invention. FIG. 10 shows the resistor in a position with very low resistance and in FIG. 11 the resistance is very high. The device can easily be described as a container 1 of non-conducting material, having a wall 2, 3 of conducting material at each end, each of the end walls 2, 3 being connected to a conductor 4, 5. In the container is a powder, e.g. $TiB_2$, with a particle size of approximately 10 $\mu$m.

The end wall 3 is displaceable laterally in the figure and is in a position in FIG. 10 where it presses strongly against the powder. In FIG. 11 the end wall is withdrawn so that it does not compress the powder.

In the state shown in FIG. 10 the powder 6 is firmly compressed so that it acquires electric properties similar to those for equivalent material in solid form. When a material like $TiB_2$, with good conductivity, is used the powder will therefore constitute a good conductor with a resistivity in the vicinity of m$\Omega$cm. The compression force is a few MPa.

In the expanded state shown in FIG. 11 the particles 6 have been given space to separate from each other so that they will brush against each other with small contact surfaces. Each contact surface gives rise to a contact resistance and the powder as a whole forms a large number of chain-linked such resistances, together producing considerable resistance between the end walls 2 and 3. In this fluffy, loosened state the powder will have a resistivity in the order of M$\Omega$cm or higher, i.e. $10^9$ times higher than in compressed state. The powder thus becomes insulating.

The displacement of the movable end wall 3 from the position shown in FIG. 10 to that shown in FIG. 11 takes place in approximately 100 $\mu$s and the increase in volume is approximately 20%. The negative pressure wave caused by the rapid increase in volume, together with the inherent spring force in the powder particles caused by the increase in volume, results in the powder particles spreading through the available space so that the loosened state ensues.

Figure 12:
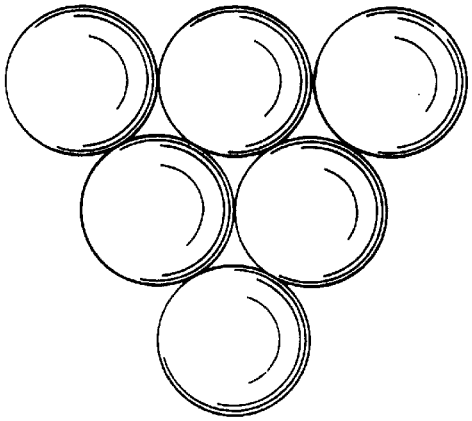
FIG. 12 shows, idealised and enlarged, some powder particles in the state shown in FIG. 11, FIG. 13 similarly shows some powder particles in the state shown in FIG. 10.
Figure 13:
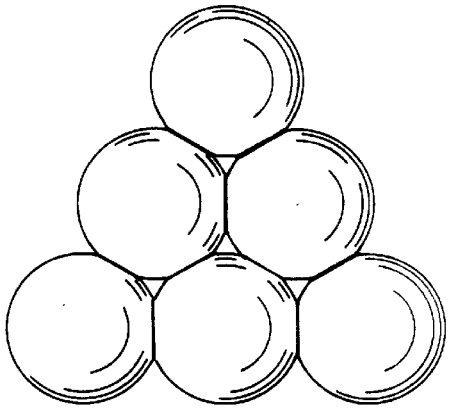

The two states are illustrated in more detail in an idealised simplification in FIGS. 12 and 13, where FIG. 12 is a partial enlargement of the powder in the state shown in FIG. 11 and FIG. 13 of the powder in the state shown in FIG. 10. In FIG. 12 the powder particles abut each other substantially pointwise, giving a high resistance over each contact point. In FIG. 13 the particles are compressed and elastically deformed against each other so that contact occurs via a considerable surface, thus making the powder conducting.

Figure 14:
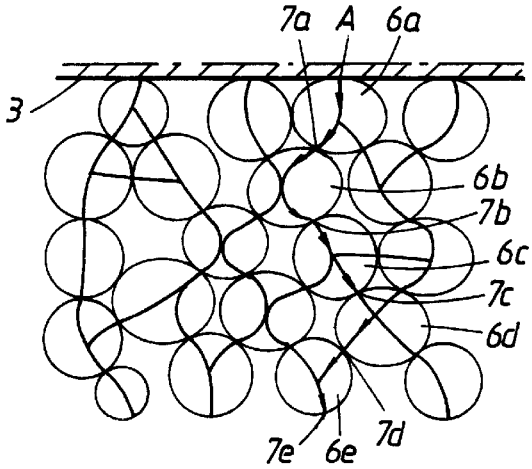
FIG. 14 is a partial enlargement of the powder in a resistor according to one embodiment of the invention, in the state shown in FIG. 11.

The loosened state is also illustrated in FIG. 14 which, on enlarged scale shows a part of the powder 6. Several parallel, branched current paths are formed, one of these, A, being marked by a line provided with arrows. The current path A runs from the end wall 3 through the particles 6*a*–6*e* and on to the opposite end wall, also passing the contact points 7*a*–7*e*, etc. As mentioned, resistance arises primarily in the contact points 7*a*–7*e* whereas the resistance through the particles is negligible.

The resistance in each contact point is dependent on the size of the contact area, which is affected by the compression force, the hardness of the powder material and the shape of the particles in the contact area. The resistance also depends on the resistivity of the powder material and on the temperature at the contact points.

If the contact area is approximated by a circle with radius a, the contact resistance $R_c$ will be $$\frac{\rho_T}{2a}$$

where $\rho_T$ is the resistivity of the particle material and where the heating effect is not taken into consideration. With $\rho_T$=25 $\mu\Omega$cm and a=50 nm, $R_c$=2.5 $\Omega$. It is assumed that a << the particle radius r, which is normally the case.

For material formed by oxide layers on the surface the resistance from this must be added to $R_c$ in order to obtain the total resistance. The oxide resistance, $$R_{ox} = \frac{2d\rho_{ox}}{\pi a^2}$$

where d is the thickness of the oxide layer and $\rho_{ox}$ the resistivity of the oxide. The total resistance R at the contact point is then $R=R_c+R_{ox}$.

The contact resistance between the electrodes, i.e. The end walls is independent of the particle size whereas the surface resistance, which comprises both the resistance from the oxide layer and from foreign substances and degrading of the surface, is inversely proportional to this.

To obtain low resistance in the contact points, which is desirable when the powder is compressed, the particle material should have low resistivity, be as round as possible and have little tendency to form oxide layers (or other insulation surface contamination). The latter acquires increased significance with small particle sizes.

In loosened state of the powder, when the resistance across each contact point is high, the contact point is subjected to high generation of heat. The temperature at the contact point increases with the voltage across this and is approximately 200° C. at a voltage of 0.1 V, increasing to approximately 3000° C. at a voltage of 1 V. The fusion temperature of the material thus sets an upper limit for the voltage drop that can be achieved across the contact point. TiC or $TiB_2$, for instance, has a melting point permitting voltage drops of up to 1 V across the contact point whereas for most metals it is considerably lower. The time taken for the temperature to reach its final value can be calculated to approximately 1 ns, i.e. heating of the contact point may be considered to occur instantaneously in comparison with the time taken for the powder in the resistor to reach loosened state.

When the powder is decompressed and given room to rapidly expand, three principal sources of the force separating the particles from each other can be identified, i.e. dynamic effects of the pressure drop in the gas containing the powder, electromagnetic forces and mechanical forces from the elastic compression of the particles. It has been established both empirically and on the basis of theoretical calculations, that the electro-magnetic forces are completely negligible and also that the elastic force clearly dominates over the gas-dynamic force and is approximately 10–100 times greater than this. In practice, therefore, the separation effect can be described as dependent primarily on the particles springing away from each other. In the case of extreme over-pressure in the gas or air, however, the gas-dynamic forces may acquire a more manifest effect.

It is important that the powder material has sufficient thermal stability to be able to absorb the heat generated when the resistor is tripped. All the materials listed in the following fulfill this requirement. $TiB_2$, $ZrB_2$ and TiC, for example, have a practically useful ability to absorb approximately 50 kJ per $cm^3$ powder.

As mentioned, the powder particles should be as round as possible in order to reduce contact resistance. This is also important from the thermal point of view since it increases the ability to conduct heat from the contact point to the interior of the particle. Round particles also give better separation effect at tripping.

Furthermore, the size of the particles should preferably vary as little as possible. This also lowers the resistivity of the powder and increases the separation effect at tripping.

Desired properties for suitable material in the powder can be established against this background. The material should thus have high fusion temperature to permit high voltage over the contact area without it melting and being fused to adjacent particles. The material should have little tendency to oxidize since the oxide layer increases the resistance between particles, which is a drawback when the powder is compressed and should have as little resistance as possible. The resistivity of the particle material itself should be low for the same reason, and the particles should also be as round as possible to minimize contact resistance. Low material costs and non-harmful to the environment are naturally also desirable features.

In addition to this, a most important property of the material in order to promote the separation is that it should been extremely hard so as to minimize the plastic deformation of the particles when they are compressed. The importance of minimizing the plastic deformation has been touched upon earlier.

The following list indicates examples of different materials which to a varying but sufficient degree satisfy the above criteria. The material is stated in the first column, its melting point in ° C. in the second column and its density in $g/cm^3$ in the third column.

| | | |
|---|---|---|
| $Cr_3C_2$ | 1890 | 6.68 |
| $HfB_2$ | 3250 | 11.01 |
| HfC | 4160 | 12.2 |
| $MoB_2$ | 2100 | 7.12 |
| MoC | 2690 | 8.2 |
| $MoSi_2$ | 2000 | 6.31 |
| $NbB_2$ | 2900 | 7.0 |
| NbC | 3500 | 7.6 |
| NbN | 2570 | 8.4 |
| $NbSi_2$ | 1950 | 5.70 |
| TaC | 3880 | 13.9 |
| TaN | 3090 | 16.3 |
| $TaSi_2$ | 2200 | 8.5 |
| $TiB_2$ | 2900 | 4.50 |
| TiC | 3140 | 4.93 |
| $TiSi_2$ | 1760 | 4.10 |
| WB | 2860 | 9.0 |
| WC | 2870 | 15.63 |
| $WSi_2$ | 2160 | 9.4 |
| $Vb_2$ | 2100 | 5.1 |
| VC | 2810 | 5.77 |
| $ZrB_2$ | 3200 | 6.08 |
| ZrC | 3540 | 6.73 |
| ZrN | 2980 | 7.09 |
| $ZrSi_2$ | 1550 | 4.88 |

Figure 15:
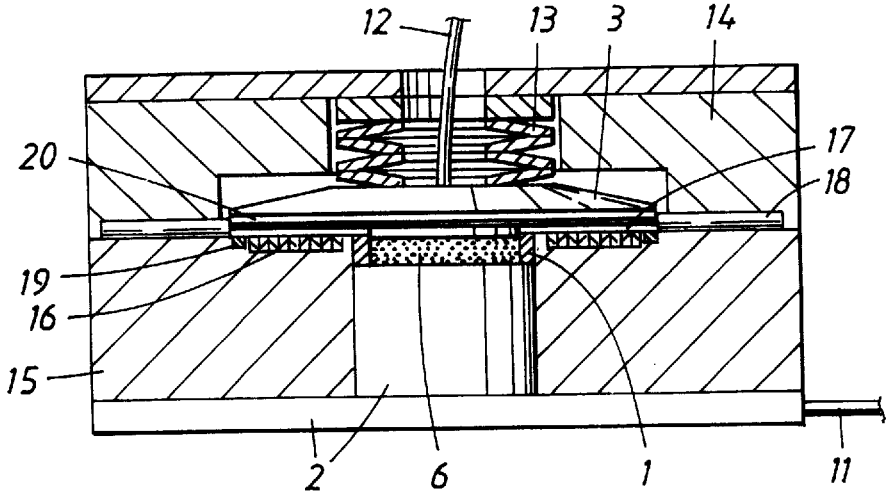
FIG. 15 illustrates schematically the trip means for the resistor.

FIG. 15 illustrates the principle for a trip mechanism according to the invention, by means of which the powder is caused to pass from the compressed, compact state to the decompressed, loosened state.

The powder 6 is shown in the figure in compact state, compressed in a chamber formed by a cylindrical wall 1 of insulating material, a stationary aluminium block 2 below the powder and a movable aluminium block 3 above the powder. The aluminium blocks 2, 3 constitute the contacts against the powder and are connected to conductors 11, 12, respectively. The movable block 3 is kept pressed against the powder 6 by a mechanical spring 13 supported, via an insulating annular block 15, by a stand 14 which is rigidly joined to the lower aluminium block. Part of the upper end surface of the insulating block 15 faces the movable aluminium block 3 and an electric coil 16 is connected to this part. The winding 16 and the movable aluminium block are separated by an air gap 17.

Tripping is effected by a current pulse through the coil 16 which induces a current in the movable aluminium block 3 so that this is quickly lifted, overcoming the force from the spring 13. The block 3 is lifted a few millimetres from the powder and the time required for this is approximately 100 $\mu$s.

The powder is thus completely decompressed and the volume of the chamber increases so that the powder can expand to loosened state, as described above.

A locking mechanism is provided, consisting of a number of radially directed rods 18 in slots in the stand 14 arranged to be automatically inserted under the movable aluminium block 3 when this is lifted, thereby preventing it from descending again.

The mechanical spring 13 may be dimensioned to produce the entire force required. Alternatively, the spring 13 may be slimmer and a part of the force be obtained with the aid of attracting magnets 19, 20. The latter alternative increases the speed since the force between the magnets 19, 20 diminishes greatly as they are moved apart.

In the device shown in FIG. 15 the movable aluminium block 3 constitutes one electrode of the resistor and also the movable wall providing the changes in pressure and volume.

Figure 16:
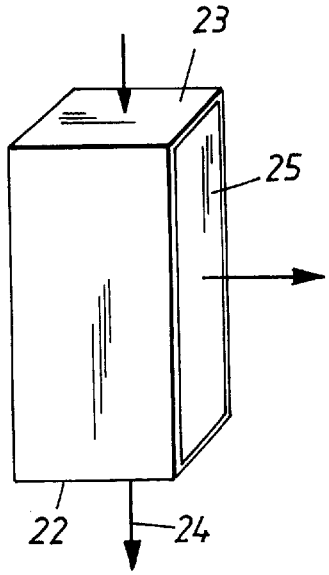
FIG. 16 illustrates schematically a first alternative embodiment of the resistor.

FIG. 16 is an outline diagram showing an alternative embodiment of the movable wall. The chamber enclosing the powder is represented in the figure by a parallelepiped in which the upper and lower end surfaces 23, 22, respectively, constitute the two electrodes, both of which are stationary and are connected to the current path 24. Instead the movable wall is comprised by one of the side walls 25. The pressure and change in volume are here directed substantially perpendicular to the direction of the current path through the powder. An advantage of this variant is that the powder is loose to the same extent throughout seen in the direction of the current path, thus giving a more uniform voltage distribution than with the embodiment described in FIG. 15 where the voltage is initially unevenly distributed since the pressure decreases and the volume increases first at one end of the resistor seen in current direction. The embodiment shown in FIG. 16 results instead initially in an uneven current distribution. This causes increased resistance, which is an advantage.

Figure 17:
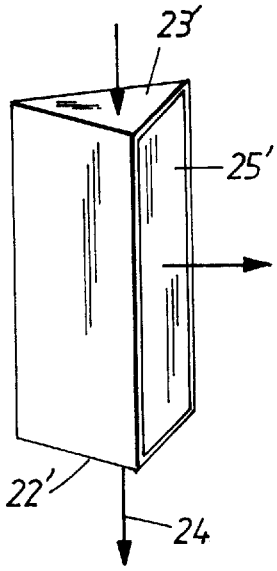
FIG. 17 illustrates schematically a second alternative embodiment of the resistor.

FIG. 17 illustrates a modification of the alternative shown in FIG. 16. Here, the chamber enclosing the powder is in the shape of a triangular prism, the end surfaces 22', 23' of the prism forming stationary electrodes and one of the side walls 25' of the prism constituting the movable wall. Such geometry of the chamber contributes to the powder being loosened up throughout its volume to a greater extent.

The shape of the chamber enclosing the powder may of course be varied in many ways within the scope of the invention, both in the alternative shown in FIG. 15 and that shown in FIGS. 16 and 17 for the direction of the change in volume in relation to the current direction. Naturally, the movable wall need not be flat but may be wedge-shaped, for instance, or corrugated. The wall or parts thereof may be made of elastic material, e.g. silicon rubber. The movable wall need not necessarily be parallel with the opposite wall or perpendicular to its direction of movement. The movement may even be such that the change in pressure is achieved by shear force or a combination of shear forces and compressive forces. The movement may alternatively be a torsional movement or a combination of torsion and translation. Neither need the electrodes necessarily be flat but may instead by convex or concave. The movement of the powder and application of the pressure on the powder can be achieved by means of isostatic pressure in a liquid, e.g. silicon oil, or a gel, e.g. silicon gel. The described function of the powder resistor refers to its function upon disconnecting or limiting the current since this is when the need for short action time is greatest. The process is the reverse during connection, when the resistor is to be brought to its conducting state and the powder is compressed. A somewhat slower process may, however, be accepted here, dimensioned in accordance with the amount of energy that must be absorbed by the resistor.

What is claimed is:

1. An electric coupling device for connecting, disconnecting or limiting the current in an electric circuit, which-electric coupling device comprises a variable resistor with resistance variable between a first value corresponding to a conducting state and a second value corresponding to a substantially insulating state, which resistor comprises a powder in a container and includes means for increasing the size of the container in a time less than 3 ms from a first volume in said conducting state to a second volume in said substantially insulating state, the resistivity of the powder being in the order of M Ωcm at said second value of the resistance and less than $10^{-6}$ times that resistivity at said first value of the resistance.

2. An electric coupling device according to claim 1, wherein the second volume is approximately 20% larger than the first volume.

3. An electric coupling device as claimed in claim 2, comprising an isolating switch arranged in series with the variable resistor.

4. An electric coupling device as claimed in claim 2, comprising a second resistor connected in parallel with the variable resistor, which second resistor may be linear or nonlinear or a combination of these.

5. An electric coupling device as claimed in claim 1, comprising an isolating switch arranged in series with the variable resistor.

6. An electric coupling device as claimed in claim 5, comprising a second resistor connected in parallel with the variable resistor, which second resistor may be linear or nonlinear or a combination of these.

7. An electric coupling device as claimed in claim 1, comprising a second resistor connected in parallel with the variable resistor, which second resistor may be linear or non-linear or a combination of these.

8. An electric coupling device as claimed in claim 7, wherein said second resistor has a resistance which is more than ten times greater than the first value corresponding to the conducting state of the variable resistor and less than ten times lower than the second value corresponding to the substantially insulating state of the variable resistor.

9. An electric coupling device as claimed in claim 8, comprising a second contact.

10. An electric coupling device as claimed in claim 7, comprising a second contact.

11. An electric coupling device as claimed in claim 10, wherein the second contact is connected in series with the variable resistor.

12. An electric coupling device as claimed in claim 10, wherein the second contact is connected in parallel with the variable resistor.

13. An electric coupling device as claimed in claim 7, comprising a second contact.

14. An electric coupling device as claimed in claim 1, comprising sensor, control means and signal means, which sensor senses one or more parameters of the electric circuit, which signal means is arranged to transmit signals from the sensor to the control means and which control means is arranged to initiate switching of the state of the variable resistor depending on signals from the sensor.

15. An electric circuit, characterized in that it is provided with at least one electric coupling device, which electric coupling device comprises a variable resistor with resistance variable between a first value corresponding to conducting state and a second value corresponding to substantially insulating state, which resistor comprises a powder in a container and includes means for increasing the size of the container in a time less than 3 ms from a first volume in said conducting state to a second volume in said substantially insulating state, the resistivity of the powder being in the order of M Ωcm at said second value of the resistance and less than $10^{-6}$ times that resistivity at said first value of the resistance.

16. An electric circuit as claimed in claim 15, comprising a plurality of branch conductors connected with a plurality of loads, wherein said at least one electric coupling device is arranged in one or more of the branch conductors.

17. A method for connecting, disconnecting and limiting the current in an electric circuit, characterized in that a variable resistor in the electric circuit is, upon connection, brought to a conducting state from a substantially insulating state, and vice versa at disconnection or limiting, the change in resistance being effected by increasing the size of a container comprising a powder in a time less than 3 ms from a first volume in said conducting state to a second volume in said substantially insulating state, the resistivity of the powder being in the order of M Ωcm at said second value of the resistance and less than $10^{-6}$ times that resistivity at said first value of the resistance.

* * * * *